US006237818B1

(12) United States Patent
Kline

(10) Patent No.: US 6,237,818 B1
(45) Date of Patent: May 29, 2001

(54) TAMPER EVIDENT POURING SPOUT

(75) Inventor: Thomas A. Kline, Ft. Wayne, IN (US)

(73) Assignee: Rieke Corporation, Auburn, IN (US)

( * ) Notice: Subject to any disclaimer, the term of this patent is extended or adjusted under 35 U.S.C. 154(b) by 0 days.

(21) Appl. No.: 09/488,064

(22) Filed: Jan. 19, 2000

(51) Int. Cl.[7] ..... B67D 3/00
(52) U.S. Cl. ..... 222/529; 222/530; 222/541.9
(58) Field of Search ..... 222/529, 530, 222/541.5, 541.9

(56) References Cited

U.S. PATENT DOCUMENTS 4,236,629 * 12/1980 Dwinell ..... 222/529
4,442,949 * 4/1984 Dwinell et al. ..... 222/541.9
4,568,006 * 2/1986 Mueller et al. ..... 222/530

* cited by examiner

*Primary Examiner*—Philippe Derakshani
(74) *Attorney, Agent, or Firm*—Kwadjo Adusei-Poku; Lloyd D. Doigan

(57) ABSTRACT

A flexible pouring spout for material containers incorporating a tamper evident ring having a nested flexible spout capable of being selectively moved between a nested position and an extended position, a cap threadedly attached to the spout, a tamper-evident ring attached to the cap by a plurality of frangible elements, and a metal ring for attaching the closure to the container. The metal ring is secured over the peripheral flange of the spout and over the tamper-evident ring, preventing the closure from being removed or the spout from being extended without detection. A flexible bail handle is attached to the cap member to facilitate extending the spout member and removing the cap. For additional tamper evidence, an internal diaphragm is used to seal off the spout until the closure is opened and the diaphragm removed.

12 Claims, 3 Drawing Sheets

TAMPER EVIDENT POURING SPOUT

BACKGROUND OF THE INVENTION

1. Field of the Invention

This invention relates to pouring spouts for material containers and, in particular, to a flexible pouring spout having a container cover, with a tamper-evident ring, and a metal securing ring, which together provide dual evidence of tampering with the container closure.

2. Description of the Prior Art

For many years, flexible pouring spouts have been used on industrial containers to facilitate repeated closure of the container using a cap member while also providing means for pouring material from the container. The spout is nested within the closure to form a low profile allowing stacking of the containers. As necessary, the spout may be pulled out to create a pouring spout for the container. One widely known spout is constructed of a low density polyethylene (LDPE) providing flexibility while the cap member threadably secured to the spout is constructed of a high density polyethylene (HDPE).

While the closure members have been regularly improved to incorporate new features, mounting of the closure within the container lid has posed problems related to quality control and product integrity. In one well-known method, a metal ring is used to secure the closure within the container lid. The closure is positioned within an opening in the container cover. The metal ring is crimped over the outer peripheral flange of the closure to hold the closure within the cover. However, the integrity of the container is left to speculation because the spout can be extended and replaced without detection or disturbance to the metal ring. Efforts to overcome this disadvantage have included ultrasonically welding the closure and spout within the container cover. Although essentially bonding the closure to the lid, this product has not been widely accepted because of problems with the repeatability of the process, high capital expenditures, and maintenance on the tooling and product limitations. Both of these methods for securing a closure within a container cover have additional disadvantages associated with added material costs, capital expenditures for insertion machinery, and recovery or recycling costs of multiple component containers.

Summary of the Present Invention

The present invention overcomes the disadvantages of the prior known container closures by providing a pouring spout with an outer tamper evident ring which are both integrally molded. The tamper-evident ring and closure combination is then secured to the container cover by use of a metal securing ring. Unlike previously used closures, the metal securing ring is placed over both the periphery of the closure and the tamper evidence ring, making it impossible to remove the closure or extend the spout without detection.

The container closure of the present invention generally includes a flexible spout; a cap member removably threadably mounted to the spout, an integrally molded tamper-evident ring removably secured to the cap member, and a metal securing ring. The spout is preferably molded of a synthetic material such as low density polyethylene (LDPE) which allows the spout to be repeatedly extended and nested within the closure. An internal tamper evident diaphragm is molded within the spout, to be removed when the spout is first used. The cap and tamper evident ring are molded of a synthetic material such as high density polyethylene (HDPE). A series of frangible bridges connect the tamper ring to the cap.

Once the container is filled, the closure member, including the spout and cap, is placed into a hole within the container lid.

The metal ring is then placed over the outer edge of the cap member in such a way as to cover the outer portion of the tamper-evident ring. The metal ring is then secured to the container lid. Thus, according to the invention, the metal ring serves to secure the closure member to the container lid, the cap member to the closure member, and to provide secondary evidence of tampering.

An additional feature of the present invention is improved bail tabs for removal of the cap member. The tabs are extended and include an undercut for easier access by the user.

Other objects, features and advantages of the invention will be apparent from the following detailed description taken in connection with the accompanying drawings.

Brief Description of the Drawing

The present invention will be more fully understood by reference to the following detailed description of a preferred embodiment of the present invention when read in conjunction with the accompanying drawing, in which like reference characters refer to like parts throughout the views and in which.

Detailed Description of a Preferred Embodiment of the Present Invention

Figure 1:
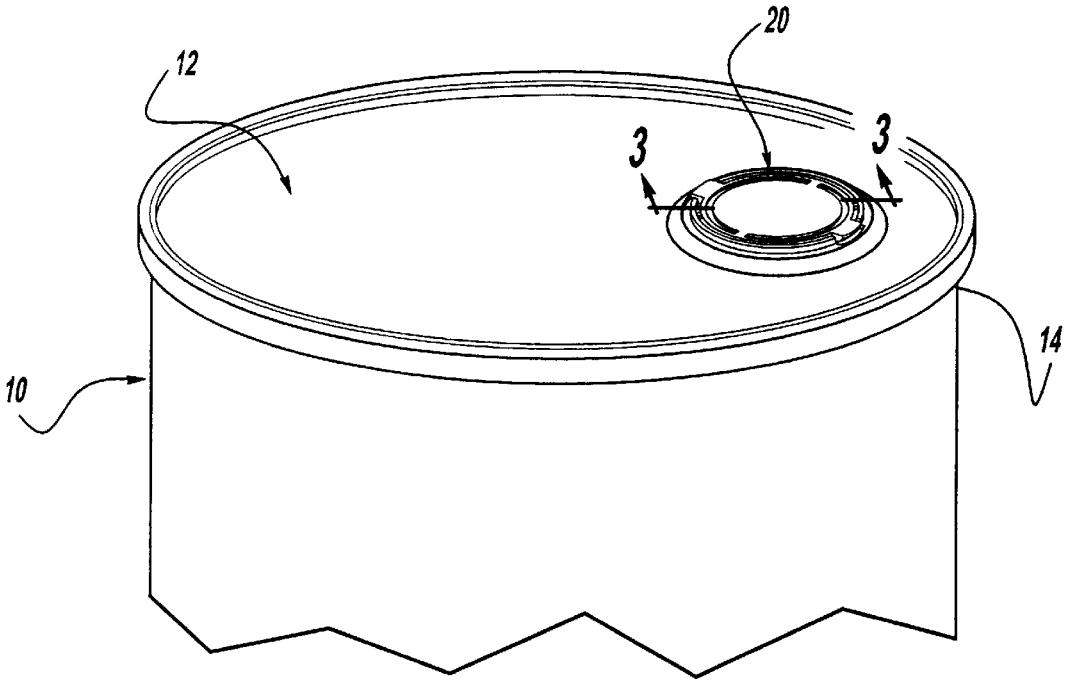
FIG. 1 is a perspective view of a portion of a container with a container cover having a closure embodying the present invention.

FIG. 1 shows the upper portion of a container 10 having a container lid 12 to maintain the material within the container 10. In a well known manner, the container lid 12 is secured to the container 10 along a lip 14 of the container 10 after the container 10 is filled. Typically, the container 10 and container lid 12 are molded of a plastic material preferably a high density polyethylene (HDPE). In order to facilitate removal of the material from the container 10, a closure 20 is inserted in the container lid 12, which allows the material to be poured or pumped from the container 10. The present invention will be described in conjunction with a pouring spout closure 20 although it is to be understood that other closures may be used in connection with the container lid, in accordance with the present invention.

Referring now to FIGS. 2–5, the closure 20 comprises a nestable spout 22 and a cap member 24, the cap member 24 having a tamper-evident ring 26 associated therewith. The spout 22 and the cap member 24 with its tamper-evident ring 26 are typically molded as an integral unit. Preferably, the spout 22 is molded of a low density polyethylene (LDPE) to provide the desired flexibility. The cap 24 and ring 26 are molded of a high density polyethylene (HDPE). Prior to inserting the cap member 24 within the lid 12, the cap member 24 is threadably attached to the flexible spout 22.

The flexible spout 22 has a throat portion 28, which includes external threads 30, a flexible neck portion 32 and an outer peripheral flange 34 that extends horizontally from the top of the neck portion. The outer peripheral flange 34 has a plurality of downwardly-extending anchor tabs 23 placed along the underside of the peripheral flange 34. The edges of the peripheral flange 34 curve downward to form a border flap 35. Molded within the throat portion 28 of the spout 22 is a removable diaphragm 36, which provides internal tamper evidence for the closure 20. The diaphragm 36 has a pull ring 38 or other grasping means which allows it to be torn out of the spout 22 by the user. In the event the diaphragm 36 is missing or partially torn from the interior of the spout 22, this provides an immediate visual indication to the user that the material within the container 10 may have been tampered with. The flexible neck portion 32 allows the spout 22 to be selectively moved between the nested position shown in FIG. 3 and an extended position (not shown) whereby the spout 22 extends beyond the plane of the container lid 12 to facilitate the pouring of material from the container 10.

The cap 24 comprises a planar top portion 40 having a downwardly-extending cylindrical portion 42 extending therefrom. The cylindrical portion 42 has internal threads 44 to cooperate with the threads 30 of spout 22. In a preferred embodiment, the cap 24 includes bail handles 46 with bail tabs 48 to facilitate removal of the cap 24 from the spout 22. Where such bail handles 46 are present, two opposing hinges 27 connect the bail handles 46 to the planar top portion 40. The bail tabs 48 extend outwardly and include an angled undercut 50 to allow easier access to the bail handles 46. The extended and undercut bail tabs 48 allow the user to position their fingers beneath the bail tabs 48 to lift the bail handles 46 so that the cap 24 may be rotated off or on the spout 22 as necessary.

Figure 2:
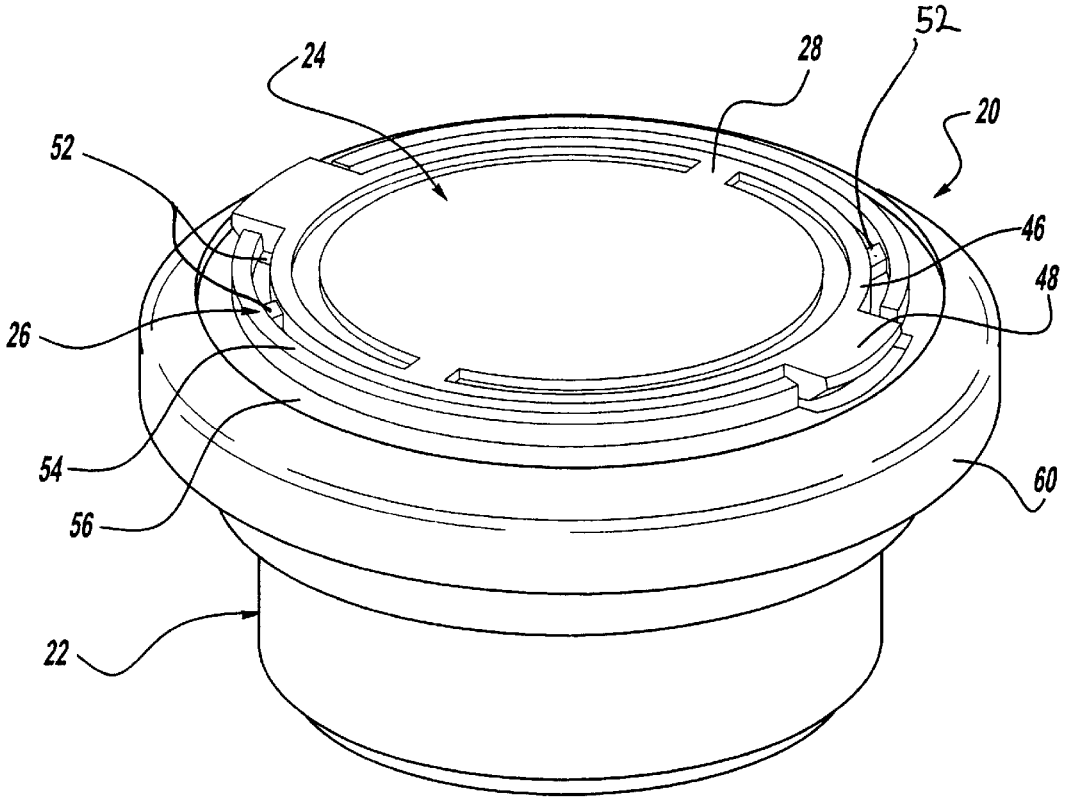
FIG. 2 is a perspective view of the closure.
Figure 5:
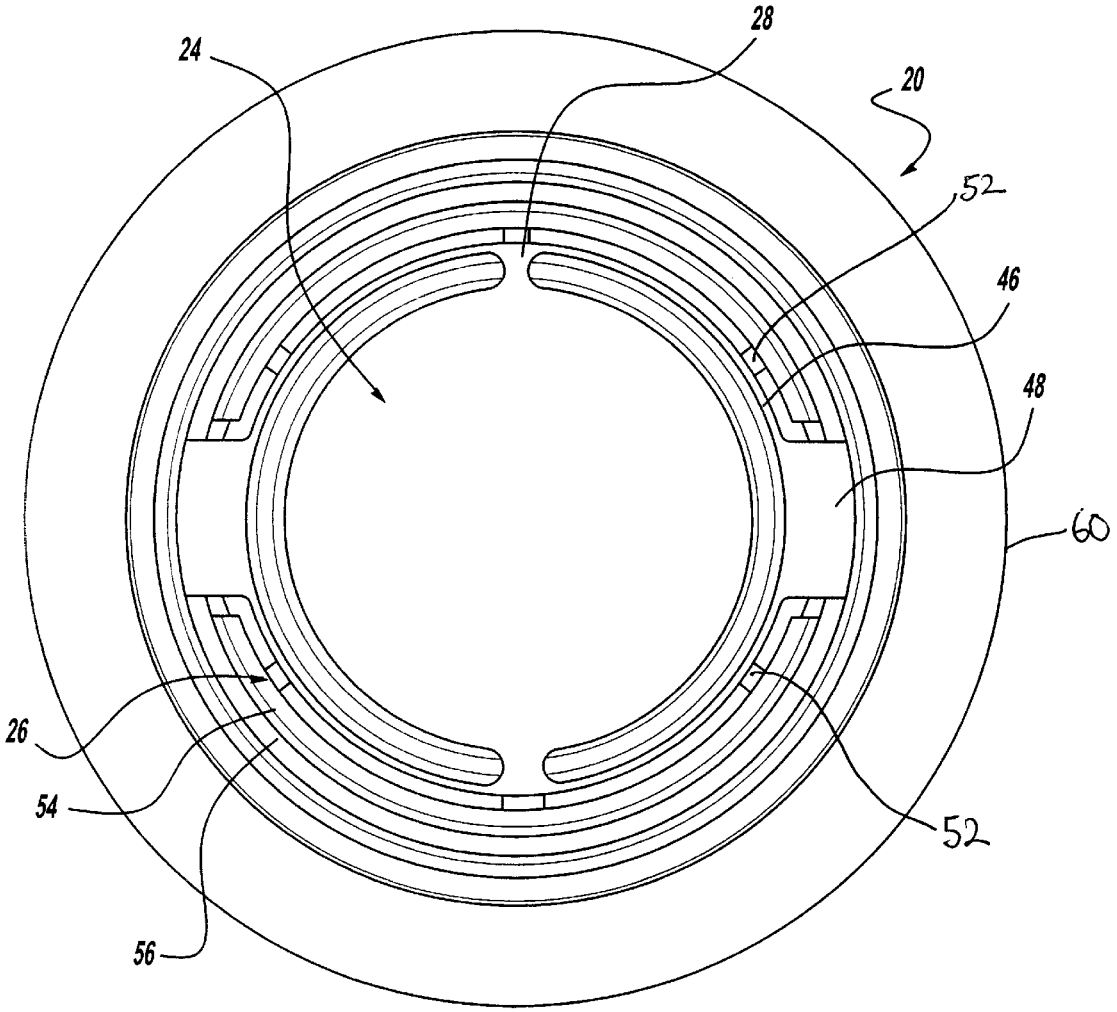
FIG. 5 is a top view of the closure.

Molded as part of the cap member 24 is the tamper-evident ring 26. The tamper-evident ring 26 is connected to the cap 24, specifically the bail handles 46, by a plurality of frangible elements 52 circumferentially spaced about the cap 24 as best illustrated in FIGS. 2 and 5. The tamper-evident ring 26 includes an annular ring 54 and a peripheral flange 56, the annular ring 54 having the frangible elements 52. The tamper-evident ring 26 provides an external visual indicator of removal of the cap 24. Raising the bail handles 46 to remove the cap 24 will cause the frangible elements 52 to break, providing a clear indication that an attempt has been made to remove the cap 24.

Figure 3:
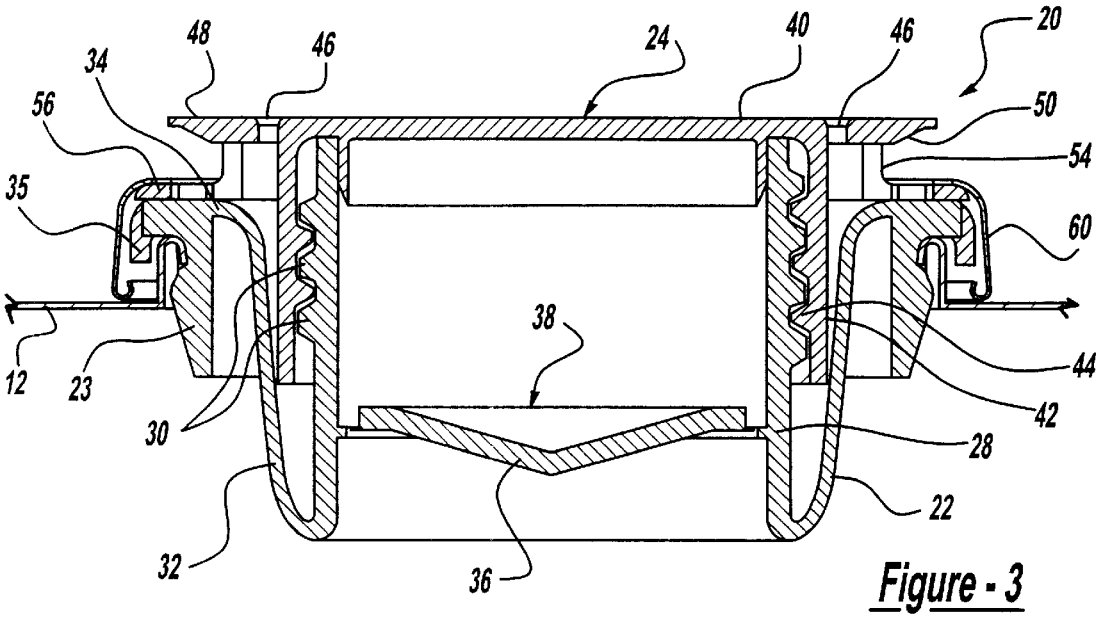
FIG. 3 is a cross-sectional view of the closure within the container cover, as taken along the line 4—4 of FIG. 1.
Figure 4:
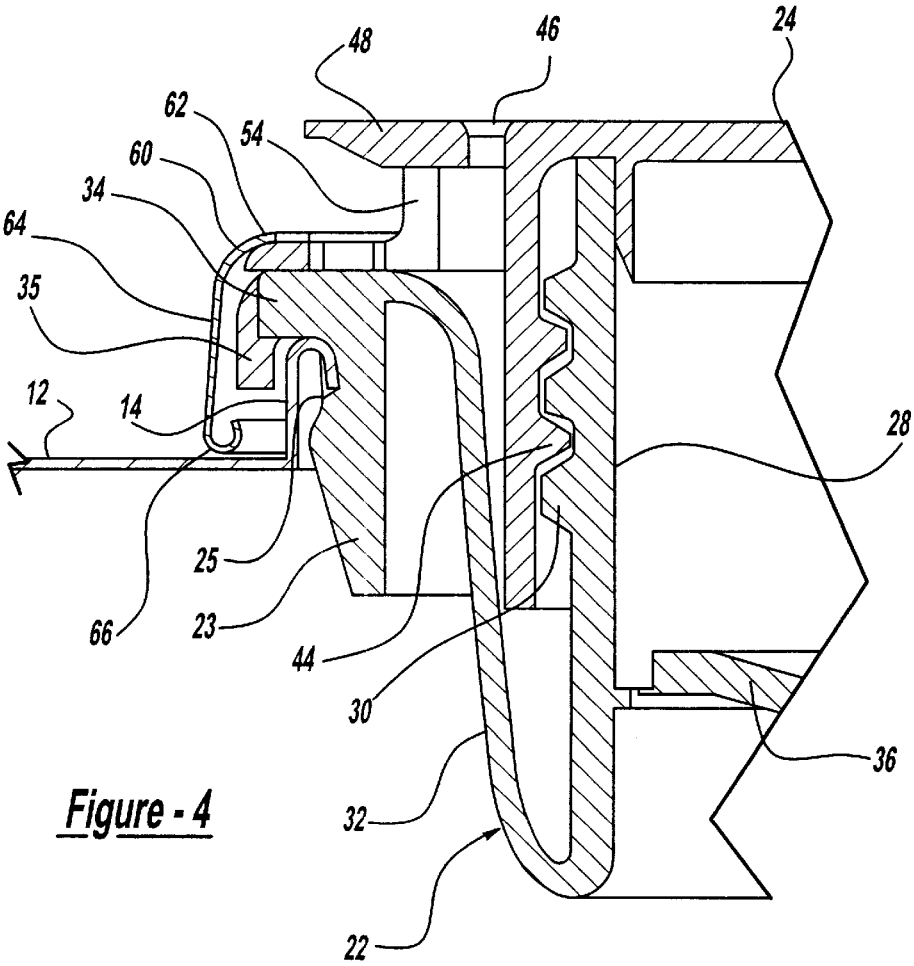
FIG. 4 is an enlarged cross-sectional view of the peripheral flange of the closure as secured to the container cover.

As shown in FIGS. 3 and 4, a metal securing ring 60 is placed over the peripheral flange 56 of the tamper-evident ring 26. In one embodiment, the metal ring 60 is arched to include a flat upper portion 62, a downwardly-extending portion 64 ending in an upwardly-curving securing hook 66. In order to secure the closure 20 to the container lid 12, the metal securing ring 60 is clamped in place over the periphery flange 56 using, preferably, some form of crimping tool. As the metal securing ring 60 is compressed radially inwards, the securing hook 66 engages beneath the border flap 35 of the peripheral flange 34. As the metal securing ring 60 is further compressed, the lid lip 14 of the container lid 12 engages the flap shoulder 25 of the anchor tab 23, thereby securing the metal securing ring 60 to the closure 20 and anchoring the closure 20 to the container lid 12. Because the metal securing ring 60 is placed over the peripheral flange 56 of tamper-evident ring 26 any attempt to manipulate the entire cap 24 together with the tamper-evident ring 60 is prevented.

Thus, the present invention integrally combines the tamperevident ring 26 with the container lid 12 providing an end product for the user, having multiple protection against tampering. The removable tear-out diaphragm 36 of the spout 24 provides internal tamper evidence. The bail handles 46 attached to both the top portion 40 of cap member 24 and the tamper-evident ring 26 will immediately indicate whether an attempt has been made to pull open or to rotate the cap member 24. Further, the securing metal ring 60 holds the tamper-evident ring 26 in place, preventing any attempt to bypass using the bail ring 46 to unscrew the cap member 24.

The foregoing detailed description has been given for clearness of understanding only and no unnecessary limitations should be understood therefrom as some modifications will be obvious to those skilled in the art without departing from the scope and spirit of the appended claims.

What is claimed is:

1. A closure for a container, comprising:

a spout member forming a passageway, the spout member having a peripheral flange therearound;

a cap member removably secured to the spout member, for closing off the passageway;

a tamper-evident ring surrounding the cap member, the tamper-evident ring being attached to the cap member by at least one frangible element, such that removal of the cap member deforms at least one of said frangible elements;

a metal ring for attaching the closure to the container, the metal ring being secured over the peripheral flange of the spout member and over the tamper-evident ring.

2. The closure as described in claim 1, wherein the spout member has:

a flexible neck portion, a cylindrical wall portion, attached to and nested within the flexible neck portion, and the peripheral flange, attached to and extending outwards beyond the flexible neck portion, such that, when the closure is anchored to the container, the spout member may be selectively moved between a nested position and an extended position.

3. The closure as described in claim 2, further comprising a diaphragm removably mounted within the cylindrical wall portion of the spout member, such that, when mounted, the diaphragm completely blocks the passageway.

4. The closure as described in claim 3, wherein the cap member is threadably attached to the spout member.

5. The closure as described in claim 1, further comprising:

a flexible bail handle hingedly attached to the cap member; and at least one bail tab attached to, and extending outwardly from, the bail handle, to facilitate lifting the bail handle.

6. A closure for a container, comprising:

a spout member forming a passageway, the spout member having a flexible neck portion, a cylindrical wall portion attached to and nested within the flexible neck portion, and a peripheral flange attached to and extending outwards beyond the flexible neck portion, such that, when the closure is anchored to the container, the spout member may be selectively moved between a nested position and an extended position;

a cap member removably secured to the spout member, for closing off the passageway;

a tamper-evident ring surrounding the cap member, the tamper-evident ring being attached to the cap member by at least one frangible element, such that removal of the cap member deforms at least one of said frangible elements; and a metal ring for attaching the closure to the container, the metal ring being secured over the peripheral flange of the spout member and over the tamper-evident ring.

7. The closure as described in claim 6, further comprising a diaphragm removably mounted within the cylindrical wall portion of the spout member, such that, when mounted, the diaphragm completely blocks the passageway.

8. The closure as described in claim 6, wherein the cap member is threadably attached to the spout member.

9. The closure as described in claim 6, further comprising:

a flexible bail handle hingedly attached to the cap member; and at least one bail tab attached to, and extending outwardly from, the bail handles, to facilitate lifting the bail handles.

10. A closure for a container, comprising:

a spout member forming a passageway, the spout member having a flexible neck portion, a cylindrical wall portion attached to and nested within the flexible neck portion, and a peripheral flange attached to and extending outwards beyond the flexible neck portion, such that, when the closure is anchored to the container, the spout member may be selectively moved between a nested position and an extended position;

a diaphragm removably mounted within the cylindrical wall portion of the spout member, such that, when mounted, the diaphragm completely blocks the passageway;

a cap member removably secured to the spout member, for closing off the passageway;

a flexible bail handle hingedly attached to the cap member;

at least one bail tab attached to, and extending outwardly from, the bail handle, to facilitate lifting the bail handle;

a tamper-evident ring surrounding the cap member, the tamper-evident ring being attached to the cap member by at least one frangible element, such that removal of the cap member deforms at least one of said frangible elements; and a metal ring for attaching the closure to the container, the metal ring being secured over the peripheral flange of the spout member and over the tamper-evident ring.

11. The closure as described in claim 10, wherein the cap member is threadably attached to the spout member.

12. The closure as described in claim 10, wherein the bail tab has an angled undercut to facilitate raising the bail handle.

* * * * *